US008606523B2

(12) United States Patent
Dinariev et al.

(10) Patent No.: US 8,606,523 B2
(45) **Date of Patent: *Dec. 10, 2013**

(54) METHOD TO DETERMINE CURRENT CONDENSATE SATURATION IN A NEAR-WELLBORE ZONE IN A GAS-CONDENSATE FORMATION

(75) Inventors: Oleg Yurievich Dinariev, Moscow (RU); Alan Sibbit, Moscow (RU); Alexander Nikolaevich Shandrygin, Moscow (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 274 days.

This patent is subject to a terminal disclaimer.

(21) Appl. No.: 13/121,287

(22) PCT Filed: Sep. 30, 2009

(86) PCT No.: PCT/RU2009/000504

§ 371 (c)(1),
(2), (4) Date: Jul. 25, 2011

(87) PCT Pub. No.: WO2010/039061

PCT Pub. Date: Apr. 8, 2010

(65) Prior Publication Data

US 2011/0276271 A1 Nov. 10, 2011

(30) Foreign Application Priority Data

Sep. 30, 2008 (RU) ..... 2008138645

(51) Int. Cl.
*G01V 1/40* (2006.01)
*G01V 5/10* (2006.01)
*E21B 49/00* (2006.01)

(52) U.S. Cl.
USPC ..... 702/8; 250/269.4; 73/152.06

(58) Field of Classification Search
USPC ..... 702/8, 1–2, 6, 11–14, 22–30, 50, 127, 702/134, 137–138, 188–189; 250/253–258, 250/265–266, 269.1, 269.4–269.5; 73/152.01–152.02, 152.06–152.09, 73/152.11, 152.14, 152.18–152.19, 73/152.22–152.23, 152.27–152.28, 73/152.41–152.42, 152.46, 73/152.51–152.52; 703/5, 9–10, 12
See application file for complete search history.

(56) References Cited

U.S. PATENT DOCUMENTS

| | | | | |
|---|---|---|---|---|
| 5,528,030 | A * | 6/1996 | Mickael | 250/269.4 |
| 5,909,772 | A | 6/1999 | Merkel et al. | |
| 2011/0276270 | A1 * | 11/2011 | Dinariev et al. | 702/8 |

FOREIGN PATENT DOCUMENTS

| | | | |
|---|---|---|---|
| RU | 2143065 | C1 | 12/1999 |
| RU | 2196228 | C2 | 1/2003 |
| RU | 2232409 | C1 | 7/2004 |
| SU | 1514918 | A1 | 1/1988 |
| SU | 1645484 | A1 | 3/1989 |

OTHER PUBLICATIONS

Abasov et al., Physical and Mathematical Simulation for Development of Gas-Condensate Fields and Fields of Volatile Oils, May 11-16, 1975, 9th World Petroleum Congress, Tokyo, Japan, 9 pp.*
Kuznetsov, G. S. et al, "Geophysical Control Methods for Oil and Gas Field Development", Moscow, Nedra Publishing House, 1991, pp. 138-139.

* cited by examiner

*Primary Examiner* — Toan Le

(57) ABSTRACT

The invention is related to the development of gas condensate deposits and may be used to determine current condensate saturation in the near-wellbore zone in the formation. The method for the current condensate saturation determination in the near-wellbore zone requires the measurement of the formation rock parameters and formation fluid parameters before the start of gas-condensate production and creation of the numerical model of the neutron logging signal change during the production period for the measured formation rock parameters and formation fluid parameters and expected condensate saturation value. During the production period when the well productivity decreases, neutron logging is performed and then the measured signals are matched with the model calculations and based on the provision of the best match of the measured and simulated neutron logging signals condensate saturation is determined.

2 Claims, No Drawings

METHOD TO DETERMINE CURRENT CONDENSATE SATURATION IN A NEAR-WELLBORE ZONE IN A GAS-CONDENSATE FORMATION

FIELD OF THE DISCLOSURE

The invention is related to the development of gas-condensate fields and may be used for the tests to determine current condensate saturation in a near-wellbore zone in a formation.

BACKGROUND OF THE DISCLOSURE

During the development of gas-condensate fields the necessity to determine a formation current condensate saturation arises because the boreholes' productivity at gas-condensate fields often sharply drops due to the condensate drop-out in the near-wellbore zone and partial locking of the gas influx into the borehole. Thus a formation fluid saturation in a near-wellbore zone may rise to 40-60% and the borehole productivity may reduce several-fold. The development of gas-condensate deposits at the pressure below the dew-point results in the condensation of liquid hydrocarbons in a productive formation. Near-wellbore zone' peculiar feature is the difference in compositions of the gas and liquid phases as well as a formation condensate saturation from the respective parameters in the remaining part of the formation. Below the dew-point the yield reduction rate experiences the influence of the so-called 'condensate bank'—a zone around a wellbore with a significant condensate saturation; the condensate banks may have the radius of several dozens meters. Simultaneously the boreholes' productivity factor may be reduced by the factor 3-4.

Until now condensate-saturation in a near-wellbore zone was not determined using geophysical research methods. Attempts have been taken to determine condensate saturation in gas-condensate formations but all of them provided the determination of condensate saturation in the entire reservoir and did not enable the determination of condensate saturation in a near-wellbore zone. Thus, USSR Certificates of Authorship Nos. 1514918 and 1645484 describe methods to determine the saturation of a gas-condensate reservoir with liquid hydrocarbons providing the injection of an indicator soluble in liquid hydrocarbons and an indicator inert to the liquid hydrocarbons with a gas carrier into the reservoir via an injection well with the subsequent record of the time when the indicators appear in the operating borehole products.

SUMMARY OF THE DISCLOSURE

The invention claimed solves the problem of the determination of current condensate saturation value in a near-wellbore zone of both cased and uncased wellbores.

The claimed method of current condensate saturation determination in a near-wellbore zone in a gas condensate formation comprises the following steps. The formation rock parameters and a formation fluid parameters are measured before starting the systematic gas-condensate production and, consequently, before the start of the condensate accumulation in the near-wellbore zone. A numerical model of a neutron logging signal change for the measured parameters of the formation, the formation fluid and expected variable condensate saturation is created. After the gas-condensate production started and well productivity decreases, a neutron logging is performed and then the measured signals are compared with the model calculations and condensate saturation is determined based on the best match of the neutron logging measured and simulated signals. The formation and formation fluid parameters measured before the wellbore operation start include formation porosity, rock mineral composition, PVT-data of the formation gas, including composition and dew-point. The parameters mentioned are measured using conventional logging methods including neutron logging and using core samples and fluid samples tests.

The expected condensate saturation is determined by hydro-dynamic modeling of the gas-condensate mixture for the set reservoir and formation fluid parameters as well as phase permeability functions, to ensure the best match of the measured and simulated neutron logging methods phase permeability functions are corrected.

DETAILED DESCRIPTION OF THE PREFERRED EMBODIMENTS

The invention is based on a new approach to the time-lapse logging data and enables determination of the current condensate saturation in the near—wellbore zone.

At the first stage a gas condensate formation opened up by a newly drilled wellbore is studied using conventional logging equipment as well as using fluid tests and formation tests. The initial condensate saturation in the formation is zero or negligible. These standard measurements will result in a set of characteristic data of the formation rock and formation fluid which include data of the formation porosity, rock mineral composition, water saturation and water composition, formation gas PVT-data, including its composition and dew-point. After that the well is used as a production well. At this stage, if the reservoir pressure drops below the dew-point, the condensate accumulates. It results in the so-called 'condensate bank' around the wellbore.

After a certain wellbore operation period a significant condensate saturation increase around the wellbore may be expected. Indirectly it may be observed as productivity factor reduction. At this stage neutron logging may be used to evaluate current condensate saturation in the condensate bank. Any neutron logging method sensitive to hydrogen index may be applied. The wellbore may be uncased or cased because the neutron flux may pass through steel pipes. The observed signal in itself cannot differentiate between gas saturation and condensate saturation because it depends on the saturation, phase density and phase composition (providing that other factors, like rock and water parameters are unchanged). However, the uncertainty of the gas condensate mixture properties may be narrowed down just to the unknown saturation using traditional hydrodynamic composition modeling. In effect, knowing the well production history it is possible to conduct a number of numerical experiments, which differ from each other by phase permeability functions. The numerical experiments will result in a set of theoretical cases of gas-oil mixture parameters significantly different from one another by the saturation values. Using this set of cases it is possible to simulate neutron logging signals. Comparing them with the measured signal it is possible to determine the actual state of the gas-condensate mixture state near the operating wellbore. It will enable evaluation of the current condensate saturation and other properties of the gas-condensate mixture.

Using gas-condensate mixture hydro-dynamic modeling software (e.g., Eclipse-300) as the output data we obtain the expected condensate saturation, gas and condensate composition. The design case input data for the simulation software include the data of the local geological structure (including distribution of the porosity and permeability along the wellbore), formation pressure and temperature data, thermodynamic data and physical-chemical properties of the formation fluids resulting from the standard measurements before the production start, data on the well production history and phase permeability functions. The phase permeability functions may be adopted as a certain current approximation (from the core test date or by analogy with a similar formation).

To evaluate the formation current condensate saturation numerical model of the neutron logging signal is used. The model input parameters include the formation porosity and water saturation, water composition, rock mineral composition, PVT-data of the formation gas including the composition and dew-point as well as the expected condensate saturation, condensate and gas composition obtained during the hydro-dynamic simulation of the gas-condensate mixture parameters.

Current condensate saturation is determined by the results of the best approximation of the simulated and obtained neutron logging signals. In case of the results divergence the phase permeability functions are corrected to obtain the best approximation of the neutron logging measured and simulated signals. The iteration sequence is stopped when the divergence between the real-life logging signal and simulated signal is negligible. At this moment the next data set is obtained: condensate saturation, formation gas and condensate composition, phase permeability functions.

What is claimed is:

1. A method for determining current condensate saturation in a near-wellbore zone of a wellbore in a gas condensate formation, the method comprising:

measuring formation parameters and formation fluid parameters before starting production of the wellbore, wherein (i) the formation parameters and the formation fluid parameters are measured by at least one of a logging tool, core testing, and fluid testing and (ii) the formation parameters and the formation fluid parameters are selected from a group consisting of formation porosity, rock mineral composition, water saturation, water composition, formation gas PVT-data, formation gas composition, and bubble point, determining an expected condensate saturation value and a composition of a gas-condensate mixture in a near-wellbore zone by hydro-dynamic modeling the gas condensate mixture using the measured formation parameters, the formation fluid parameters, and phase permeability functions, creating a numerical model to simulate neutron logging signal change during production using the measured formation parameters, the formation fluid parameters, the expected condensate saturation value, and the determined gas-condensate mixture composition, starting production of the wellbore, performing neutron logging using a neutron logging tool and measuring neutron logging signals after a decrease in well productivity, comparing the measured neutron logging signals with the simulated neutron logging signals, and determining the current condensate saturation by adjusting the phase permeability functions so that a match is obtained between the measured neutron logging signals and the simulated neutron logging signals.

2. The method of claim 1 wherein the logging tool is a neutron logging tool.

* * * * *